US008162333B1

(12) United States Patent
Bartlett

(10) Patent No.: US 8,162,333 B1
(45) Date of Patent: Apr. 24, 2012

(54) COMBINATION CHILD WALKER AND HIGH CHAIR

(76) Inventor: Albertha L. Bartlett, Nassau (BS)

( * ) Notice: Subject to any disclaimer, the term of this patent is extended or adjusted under 35 U.S.C. 154(b) by 352 days.

(21) Appl. No.: 12/386,466

(22) Filed: Apr. 17, 2009

Related U.S. Application Data

(60) Provisional application No. 61/124,421, filed on Apr. 17, 2008.

(51) Int. Cl.
*B62M 1/00* (2010.01)
*B62B 7/00* (2006.01)

(52) U.S. Cl. ..... 280/87.05; 280/87.051; 280/643; 280/648

(58) Field of Classification Search ..... 280/87.051, 280/87.05, 642, 643, 647, 648, 649, 650, 280/47.38, 47.4; 297/118
See application file for complete search history.

(56) References Cited

U.S. PATENT DOCUMENTS

| | | | | | |
|---|---|---|---|---|---|
| 207,698 | A | | 9/1878 | Want | |
| D151,417 | S | * | 10/1948 | Sverdlik | D6/335 |
| 2,754,889 | A | * | 7/1956 | Lovelace | 297/118 |
| 4,045,045 | A | * | 8/1977 | Boucher et al. | 280/87.051 |
| 4,615,523 | A | * | 10/1986 | Chen | 280/87.05 |
| D287,196 | S | | 12/1986 | Ryder-Smith | |
| D296,732 | S | | 7/1988 | Ausbon | |
| D297,684 | S | | 9/1988 | Taylor, Sr. | |
| 4,953,851 | A | | 9/1990 | Sherlock et al. | |
| 5,230,523 | A | * | 7/1993 | Wilhelm | 280/30 |
| 5,375,869 | A | | 12/1994 | Hsiao | |
| 5,673,924 | A | | 10/1997 | Demick et al. | |
| 5,829,826 | A | * | 11/1998 | Ziccardi | 297/118 |
| 6,012,731 | A | * | 1/2000 | Liu | 280/87.051 |
| 6,367,874 | B2 | | 4/2002 | Casini | |
| 6,550,857 | B1 | | 4/2003 | Canton | |
| 7,025,364 | B1 | | 4/2006 | Clarke | |
| 2004/0119258 | A1 | * | 6/2004 | Yoo | 280/87.051 |

* cited by examiner

*Primary Examiner* — J. Allen Shriver, II
*Assistant Examiner* — James M Dolak
(74) *Attorney, Agent, or Firm* — Montgomery Patent & Design, LLC; Robert C. Montgomery; Joseph T. Yaksich

(57) ABSTRACT

An apparatus that combines the functionality of a high chair and a child walker into one integral device is herein disclosed. The frame extends upward using a tubular structure which allows the apparatus to raise from a lower walker height thereto a high chair height. The apparatus provides an interchangeable seat system comprising a textile walker seat and a semi-rigid high chair seat with a footrest. Additionally, the wheels lock into place to prevent the apparatus from rolling about while in the raised high chair position. The overall tray area surrounding the child then serves as a table upon which the child can eat.

18 Claims, 8 Drawing Sheets

COMBINATION CHILD WALKER AND HIGH CHAIR

RELATED APPLICATIONS

The present invention was first described in and claims the benefit of U.S. Provisional Application No. 61/124,421, filed Apr. 17, 2008, the entire disclosures of which are incorporated herein by reference.

FIELD OF THE INVENTION

The present invention relates generally to a walker and high chair and, more particularly, to a combination child walker which is convertible to a high chair which provides multiple uses.

BACKGROUND OF THE INVENTION

Packing all the items one needs for a trip is a hassle, but assembling all the various items needed for a trip with a baby can be a daunting task. Many parents feel the need to buy larger vehicles when they start a family, in no small part due to the extra space required to transport all of baby's needs. Playpens, strollers, cribs, walkers, car seats, and high chairs are only a few examples of the larger items parents must bring along. Most of these devices lack versatility which in the end requires parents to bring along each item independently.

Two (2) of the most common items that come to mind when packing for a trip and everyday use are the high chair and an infant walker, but they both occupy precious space. The high chair is necessary at meal time and holds the child while at a table during eating and helps minimize the mess. The walker helps the child to learn how to walk and keeps the child from the floor where they could get dirty or hurt. Finally, and perhaps most important, the cost purchasing all of the devices needed for the child's early years can be a harsh burden on parents.

Examples of these devices include, U.S. Pat. No. 207,698, issued in the name of Want, describes an improved baby-walker comprising a lower ring, a plurality of posts and braces, and an upper ring that enables the walker to hingedly swing open to receive the baby. U.S. Pat. No. 4,953,851, issued in the name of Sherlock et al., describes a safety mobilizer walker comprising a hinged curved arm at one (1) end of a "C"-shaped rim, four (4) vertical support legs affixed to the rim, four (4) brace members affixed to the support legs, and sling seat.

Various attempts have been made to overcome the disadvantages described above and provide for a more versatile and multifunctional device for babies and small children. Although these attempts often suffer from disadvantages of their own including, combination devices that still require numerous other devices to cover all baby's needs or complicated modular devices that can require as much space as the corresponding independent devices.

Examples of such attempts include, U.S. Pat. No. 5,230,523, issued in the name of Wilhelm, describes a multi-functional child carrier device comprising a base, a detachable seat, a detachable backrest, pivoting push handle, telescoping legs, removable wheels, and various other modular components and providing for multiple functional uses as a child safety seat, an infant carrier seat, or a high chair.

U.S. Pat. No. 6,550,857, issued in the name of Canton, describes a convertible high chair and rocker comprising lateral pairs of curved pivotally-connected legs that extend to elevate the high chair configuration and provide a rocker means when the chair is lowered. A pullingly engaged knob provides a means of disengaging catch hooks such that the chair can be raised and lowered.

U.S. Pat. No. 7,025,364, issued in the name of Clarke, describes a combined stroller, walker, and play station comprising a wheeled carriage, a stroller-type push handle, a pivotable seat that can be rotated three hundred-sixty degrees (360°), and a stowable support tray that provides a play station area.

Other relevant attempts to address these disadvantages include U.S. Pat. Nos., 5,375,869; 5,673,924; and 6,367,874.

Additionally, ornamental designs for high chairs and strollers exist, particularly, U.S. Pat. Nos. D 287,196; D 296,732; D 297,684; D 493,624. However, none of these designs are similar to the present invention.

While these devices fulfill their respective, particular objectives, each of these references suffers from one (1) or more of the aforementioned disadvantages. Accordingly, there is a need for a means by which a high chair and a walker can be modified to address the above-mentioned deficiencies. The development of the invention herein fulfills this need.

SUMMARY OF THE INVENTION

In view of the foregoing references, the inventor recognized the aforementioned inherent problems and observed that there is a need for an invention that substantially departs from the conventional solutions and in doing so provides an apparatus that combines the functionality of a high chair and a child walker into an integral device without the aforementioned problems and thus, the object of the present invention is to solve the aforementioned disadvantages.

To achieve the above objectives, it is an object of the present invention to provide a combination child walker and high chair that combines the functionality of a high chair and a child walker into a single unit. A tubular frame body comprising a telescoping scissor-type arrangement of tubular elements enables a seat and tray portion to rise from a lower walker state to a raised high chair state above a floor surface. The combination child walker and high chair provides for interchangeable seat portions and a plurality of locking casters around a large circular base to prevent rolling or tipping while the combination child walker and high chair is in the raised high chair state.

Another object of the combination child walker and high chair is to provide an apparatus comprising a stationary tray, an adjustable tray, a plurality of tray locking mechanisms, a back rest, a base ring, a plurality of casters, a tubular frame body, a pair of mounting bars, and a plurality of tubular locking mechanisms.

Yet still another object of the combination child walker and high chair is to provide a tubular frame body comprising four (4) upper tubes, four (4) lower tubes, and a plurality of tubular locking mechanisms. The upper tubes telescopingly insert into the lower tubes and are secured by a tube locking collar when in the lowered walker state and the raised high chair state.

Yet still another object of the combination child walker and high chair is to provide tubular locking mechanisms comprising four (4) tube locking collars, two (2) tube joint locking mechanisms, four (4) lateral tube clamps, and four (4) lateral tube clamp knobs. The apparatus is secured in the lowered walker state and the raised high chair state by engaging the tubular locking mechanisms.

Yet still another object of the combination child walker and high chair is to provide a base ring comprising a large ring-shaped base foundation having curved outward surfaces and providing protection to various objects which may come into incidental contact with the base ring while being used in the walker state.

Yet still another object of the combination child walker and high chair is to provide two (2) mounting bars arranged in parallel along an inside surface of the base ring and provides an attachment means to the lateral tube clamps which sliding traverse the length of the mounting bars.

Yet still another object of the combination child walker and high chair is to provide an apparatus that is easily converted to and from a child's walker to and from a high chair by disengaging the tubular locking mechanisms and raising or lowering the tray and seat members thus extending and retracting the telescoping tubular support structure in a simple single motion manner.

Yet still another object of the combination child walker and high chair is to provide a plurality of locking casters that are insertingly connected to an underside surface of the base ring and providing a mobility means when in the walker state. Each locking caster comprises a locking mechanism that immobilizes the castors and provides aF stabilization means when in the high chair state.

Yet still another object of the combination child walker and high chair is to provide a stationary tray comprising a "U"-shaped member and stationary tray cushion wraps around the back of an occupying child and extends forward along each side which provides a slidingly engaged attachment means to the adjustable tray. The adjustable tray comprises a generally rectangular shape, a large recessed area, and a cylindrical tray cushion and provides an eating or playing surface to the occupying child and is secured to the stationary tray via the tray locking mechanisms.

Yet still another object of the combination child walker and high chair is to provide an apparatus that provides a comfortably sized adjustable means to secure the occupying child and a cushioned protection to the occupying child's body.

Yet still another object of the combination child walker and high chair is to provide interchangeable seat portions comprising a fabric walker seat shell and a semi-rigid plastic high chair seat and providing a simple conversion means for use of the apparatus as a walker and a high chair. The interchangeable seat portions are removably secured to the stationary tray via a plurality of keyhole fasteners.

Yet still another object of the combination child walker and high chair is to provide a method of utilizing the apparatus that provides the separate functionality of a walker and a high chair in a single combined unit with additional functional features in a manner which is quick, easy and effective.

Further objects and advantages of the combination child walker and high chair will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
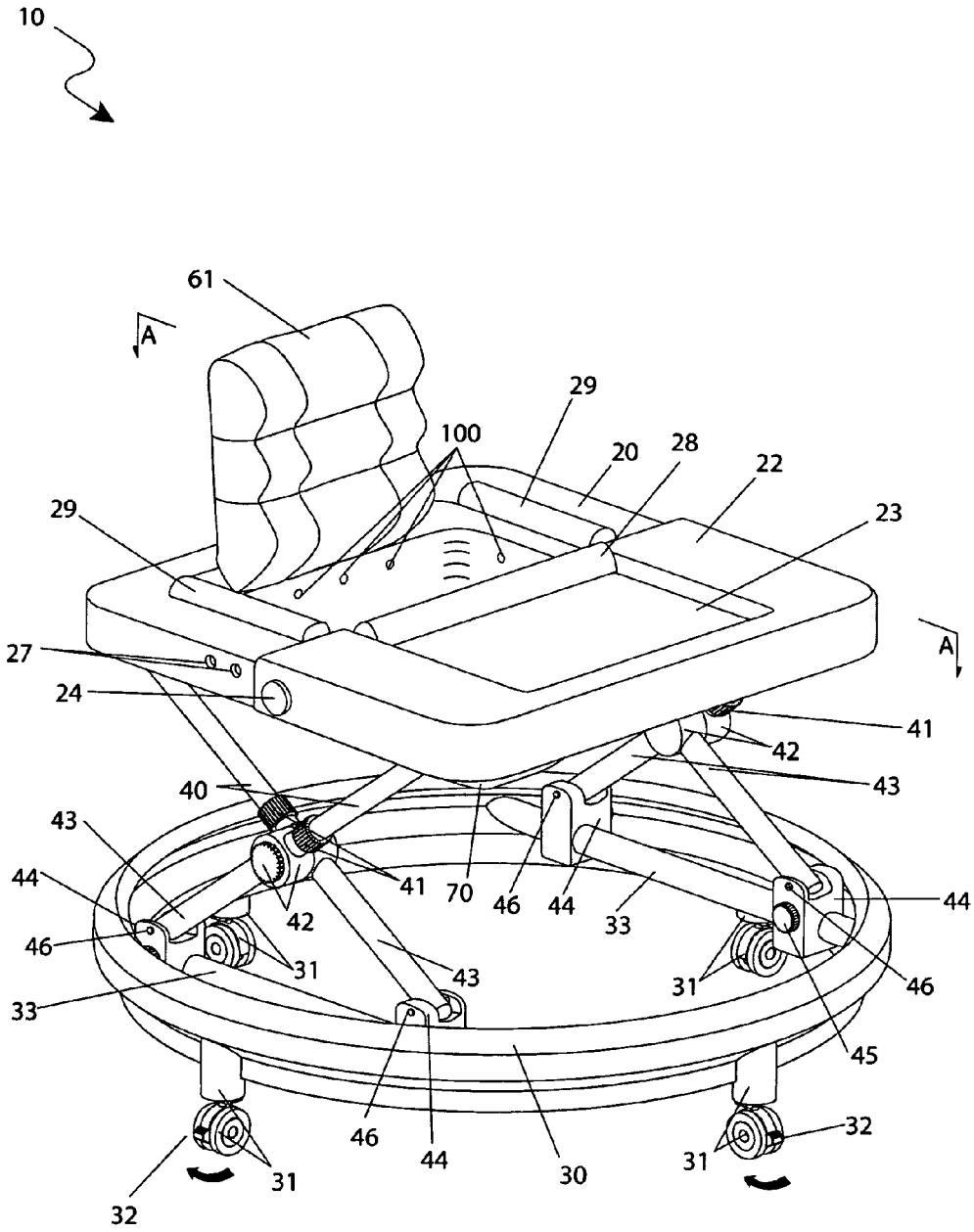
FIG. 1 is a side perspective view of a combination child walker and high chair 10 depicting a child walker state, according to a preferred embodiment of the present invention; and, FIG. 2 is a side perspective view of a combination child walker and high chair 10 depicting a child high chair state, according to a preferred embodiment of the present invention.

10 combination child walker and high chair
20 stationary tray
22 adjustable tray
23 tray recessed area
24 tray locking mechanism
27 adjustment aperture
28 adjustable tray cushion
29 stationary tray cushion
30 base ring
31 locking caster
32 caster locking mechanism
33 mounting bar
40 upper tube
41 tube locking collar
42 tube joint locking mechanism
43 lower tube
44 lateral tube clamp
45 lateral tube clamp knob
46 first pivot pin
47 tube pivot slot
48 second pivot pin
60 back rest support member
61 back rest
63 walker seat shell
65 walker seat leg aperture
70 high chair seat
72 foot rest
74 high chair crotch strap
100 locking fastener
105 keyhole aperture feature
110 snap fastener
120 common fastener

DETAILED DESCRIPTION OF THE PREFERRED EMBODIMENT

The best mode for carrying out the invention is presented in terms of its preferred embodiment, herein depicted within the FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a combination child walker and high chair (herein described as the "apparatus") 10, which combines the functionality of a high chair and a child walker into a unitary apparatus 10. A tubular frame 40 extends upwardly using a telescoping scissor-type arrangement of tubular elements, thereby allowing a tray portion 22 of the apparatus 10 to raise therefrom a lower height of approximately sixteen (16) inches thereto a raised height of approximately thirty-six (36) inches above a floor surface. The apparatus 10 provides interchangeable seat portions including a fabric walker seat shell 63 and a semi-rigid plastic high chair seat 70. Additionally four (4) locking casters are provided around a large circular base 30 to prevent the apparatus 10 from rolling and/or tipping while in the raised high chair state.

Referring now to FIG. 1, a side perspective view of the apparatus 10 depicting a lowered child walker state, according to the preferred embodiment of the present invention, is disclosed. The apparatus 10 comprises a stationary tray 20, an adjustable tray 22, a back rest 61, a base ring 30, four (4) locking casters 31, four (4) upper tubes 40, and four (4) lower tubes 43. The apparatus 10 is illustrated here depicting fully collapsed and locked upper 40 and lower 43 tubes. The apparatus 10 is secured thereinto a walker state by tightening tubular locking mechanisms including four (4) tube locking collars 41, a pair of tube joint locking mechanisms 42, and four (4) lateral tube clamps 44. While in the walker state, the adjustable tray portion 22 of the apparatus 10 is elevated to approximately sixteen (16) inches above a floor surface.

The stationary tray 20 comprises a "U"-shaped horizontal plastic form wrapping around side and rear portions of an occupying child and extending in a forward direction along each side of said occupant. The stationary tray 20 further comprises two (2) plastic covered foam-rubber stationary tray cushions 29 positioned along top surfaces of both side portions of said stationary tray 20 being affixed thereto using common fastening means 120 such as rivets, screws, adhesives, or the like. The stationary tray 20 provides an attachment means thereto the adjustable tray 22. The adjustable tray 22 provides a generally rectangular-shaped eating or playing area thereto a child while positioned therein a centrally-located open area formed therebetween the stationary 20 and adjustable 22 trays. The stationary tray 20 and adjustable tray 22 are envisioned to be made of rugged shock-resistant plastic materials such as, but not limited to: polypropylene, acrylonitrile butadiene styrene (ABS), or the like, made in an injection-molding process using specialized molds being common in the industry. Additionally, the stationary tray 20 and adjustable tray 22 are envisioned to be introduced and molded therein a variety of decorative colors and patterns based upon a user's preference. The adjustable tray portion 22 also comprises a large tray recessed area 23 so as to contain loose objects placed thereupon such as, food, toys, eating utensils, or the like. The adjustable tray 22 comprises a slidingly engaging top surface thereto a corresponding top surface area of the stationary tray 20 via interlocking horizontal and vertical molded features such that the adjustable tray portion 22 forms an extension of the stationary tray 20.

Said stationary 20 and adjustable 22 tray portions are secured in relative position thereto each other via a pair of tray locking mechanisms 24. The tray locking mechanisms 24 provide a secure connection therebetween the stationary tray 20 and the adjustable tray 22 similar thereto popular high chair tray designs common in the industry. The adjustable tray portion 22 may be horizontally variably positioned or completely removed via the tray locking mechanisms 24 and adjustment apertures 27. The tray locking mechanisms 24 provide an attachment means thereto side vertical surfaces of the adjustable tray 22 further comprising a spring-loaded knob-and-post device secured thereto said adjustable tray portion 22 using common fasteners 120. The tray locking mechanisms 24 are capable of slidingly engaging the protruding post portion thereinto a plurality of equally-spaced adjustment apertures 27 being correspondingly located along each mating side surface of the stationary tray 20. Said tray locking mechanisms 24 and adjustment apertures 27 provide a variety of secured positions of the adjustable tray portion 22, thereby providing a corresponding front-to-back opening therebetween said stationary 20 and adjustable 22 trays. The adjustability of the adjustable tray 22 provides a comfortable sized center opening thereto different sized occupying children.

The stationary tray 20 further comprises a padded back rest 61 extending in a side-to-side manner along an edge portion adjacent thereto an occupying child, thereby providing protection and stability thereto the child in an expected manner. The padded back rest 61 comprises a slightly inclined comfortable contact surface thereto an occupying child being affixed thereto the stationary tray 20 via an integral molded-in back rest support member 60 (see FIG. 3*b*). The adjustable tray 22 further comprises a cylindrical tray cushion 28 extending thereacross a rearward edge of said adjustable tray 22 adjacent thereto the occupying child. The adjustable tray cushion 28, stationary tray cushion 29, and back rest 61, comprise a plastic covered urethane foam members providing cushioned protection thereto the child's torso, facial areas, and other portions, being especially beneficial when the child is engaged therein a walker activity. Said padded members 28, 29, 61 are affixed thereto respective tray portions 20, 22 preferably using common fasteners such rivets or adhesives; however, removable fastening means such as hook-and-loop strips, snap fasteners 110, or the like may be utilized to allow easy removal, cleaning, and replacement thereof. Said padded members 28, 29, 61 are also envisioned to be introduced in a variety of decorative colors and patterns based upon a user's preference. The stationary tray 20 further provides an attachment means thereto interchangeable seat portions affixed therealong lower surfaces thereof (see FIGS. 3 and 4).

The base ring 30 comprises a large horizontal ring-shaped foundation thereto the apparatus 10 being approximately three (3) feet in diameter and having gently curved outwardly facing surfaces, thereby providing protection thereto various appliances, furnishings, and the like during incidental contact therewith when used as a walker. The base ring 30 further comprises four (4) equally-spaced locking swivel casters 31 attached thereto molded features of the base ring 30 designed to insertingly receive corresponding vertical axle portions of said locking casters 31. It is understood that additional locking casters 31 may be provided for increased stability thereto the apparatus 10 and as such should not be interpreted as a limiting factor of the present invention 10. The locking casters 31 are envisioned being commercially available devices providing common single or double plastic wheel designs with digit activated quarter-turn caster locking mechanisms 32 located thereon outer surfaces, thereby providing a stabilizing means thereto the apparatus 10 when used in the high chair state (see FIG. 2). The base ring 30 is envisioned being made using similar rugged materials as the aforementioned stationary tray 20. Furthermore, said base ring 30 is envisioned to provide a significant evenly-distributed stabilizing mass therearound so as to establish a low center of gravity thereto, thereby reducing possible tipping of the apparatus 10 during use in the high chair state.

The base ring 30 further comprises a pair of mounting bars 33. The mounting bars 33 are arranged being parallel thereto each other and positioned along opposing inside surfaces of the base ring 30. Said mounting bars 33 comprise strong solid or hollow members approximately one (1) inch in diameter being permanently affixed at both end portions thereto inner surfaces of the base ring 30 using common fasteners 120 such as screws, bolts, or the like. Said mounting bars 33 provide an attachment means thereto a telescoping tubular support structure which extends in an upward direction therebetween the base ring 30 and the stationary tray 20.

Said telescoping tubular support structure comprises four (4) upper tubes 40 and four (4) lower tubes 43 to form a vertically expanding scissor-like structure providing a vertically adjustable and lockable assembly means capable of variably elevating the tray portions 20, 22 of the apparatus 10 therebetween approximately sixteen (16) and thirty-six (36) inches above a floor surface. The lower tubes 43 extend upwardly therefrom the mounting bars 33 being affixed thereto via four (4) lateral tube clamps 44. Said lateral tube clamps 44 provide an interconnecting means therebetween the mounting bars 33 and the lower tubes 43 providing an offset and hinging means thereto the lower tubes 43 and slidingly engaged thereonto the mounting bars 33. Said engagement thereof allows sliding motioning of said lower tubes 43 in a horizontal direction along said bars 33. The lateral tube clamps 44 further comprise lateral tube clamp knobs 45, thereby securing the two (2) pairs of lower tubes 43 at relative convergent angles thereto each other. Each pair of lower tubes 43 extends upwardly therefrom respective lateral tube clamps 44 in an offset and converging fashion to form a crossing junction which is secured both positionally and angularly via a tube joint locking mechanism 42. Each tube joint locking mechanism 42 comprises a cylindrical knob-actuated double-clamping device designed to receive and positionally lock two (2) adjacent tubular elements at a relative crossing position and angle thereto each other via tightening of respective knob portions. Each of the four (4) lower tubes 43 continues to extend upwardly being slidingly received therein respective upper tubes 40 in a telescoping manner.

The upper tubes 40 comprise a particular inside diameter so as to provide a snug sliding fit thereto said lower tubes 43. Each upper tube 40 further comprises an integral tube locking collar 41 affixed thereto using interlocking annular molded features along a lower end portion of each upper tube 40. The tube locking collars 41 comprise a common rotary split collar clamping devices providing a secure clamping means thereto respectively inserted lower tubes 43 being similar thereto photography tripods and awnings. However, said tube locks 41 are not limited to the preferred locking collar embodiment, and a person skilled in the art will appreciate that many other embodiments of the tube locks 41 are possible without deviating from the basic concept and as such should not be interpreted as a limiting factor thereof. The upper tubes 40 extend in an upward direction providing a pivoting attachment means thereto the stationary tray 20 via four (4) second pivot pins 48 comprising molded horizontally extending cylindrical appendages of the stationary tray 20 being located along inner surfaces of opposing side portions thereof, thereby providing a rotary connecting means thereto the upper tubes 40 (see FIGS. 3*a* and 4*a*).

The upper tubes 40, lower tubes 43, and attaching elements are envisioned to be made using rugged metal or plastic materials being offered in a variety of colors and patterns based upon a user's preferences.

Figure 2:
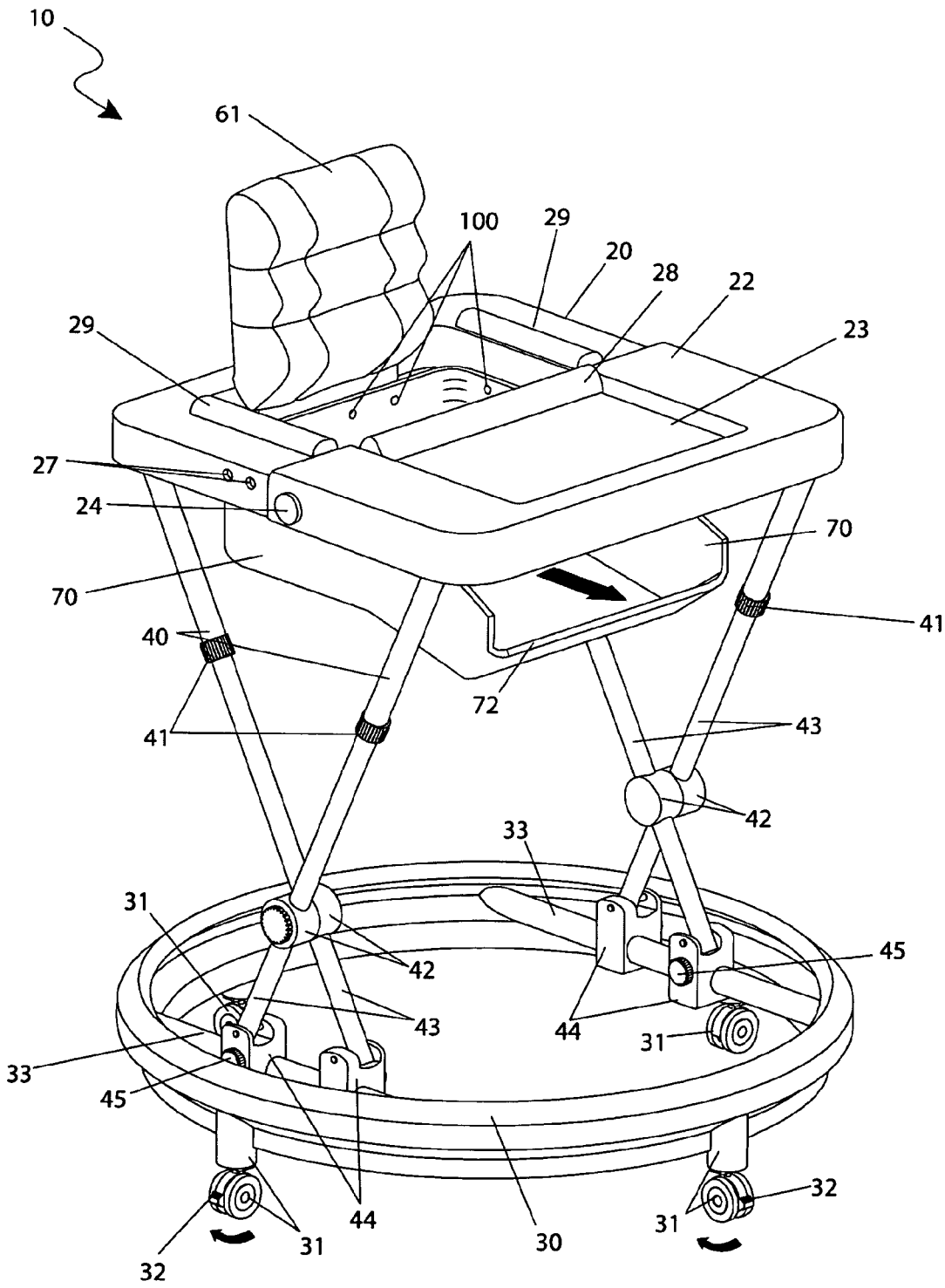

Referring now to FIG. 2, a side perspective view of the apparatus 10 depicting a child high chair state, according to the preferred embodiment of the present invention, is disclosed. The apparatus 10 as shown here comprises upwardly extended and secured upper tubes 40 and lower tubes 43. Correspondingly, the lateral tube clamps 44 have been repositioned therealong each mounting bar 33. The apparatus 10 is secured therein the high chair state by tightening the tube locking collars 41, the tube joint locking mechanisms 42, and the lateral tube clamps 44. While in the high chair state, the adjustable tray portion 22 of the apparatus 10 is elevated to approximately thirty-six (36) inches above a floor surface. The apparatus 10 further comprises a removably attachable high chair seat 70 with an integral high chair foot rest 72 being installed thereto the stationary tray portion 20 via a plurality of locking fasteners 100 (see FIG. 4*b*).

Figure 3A:
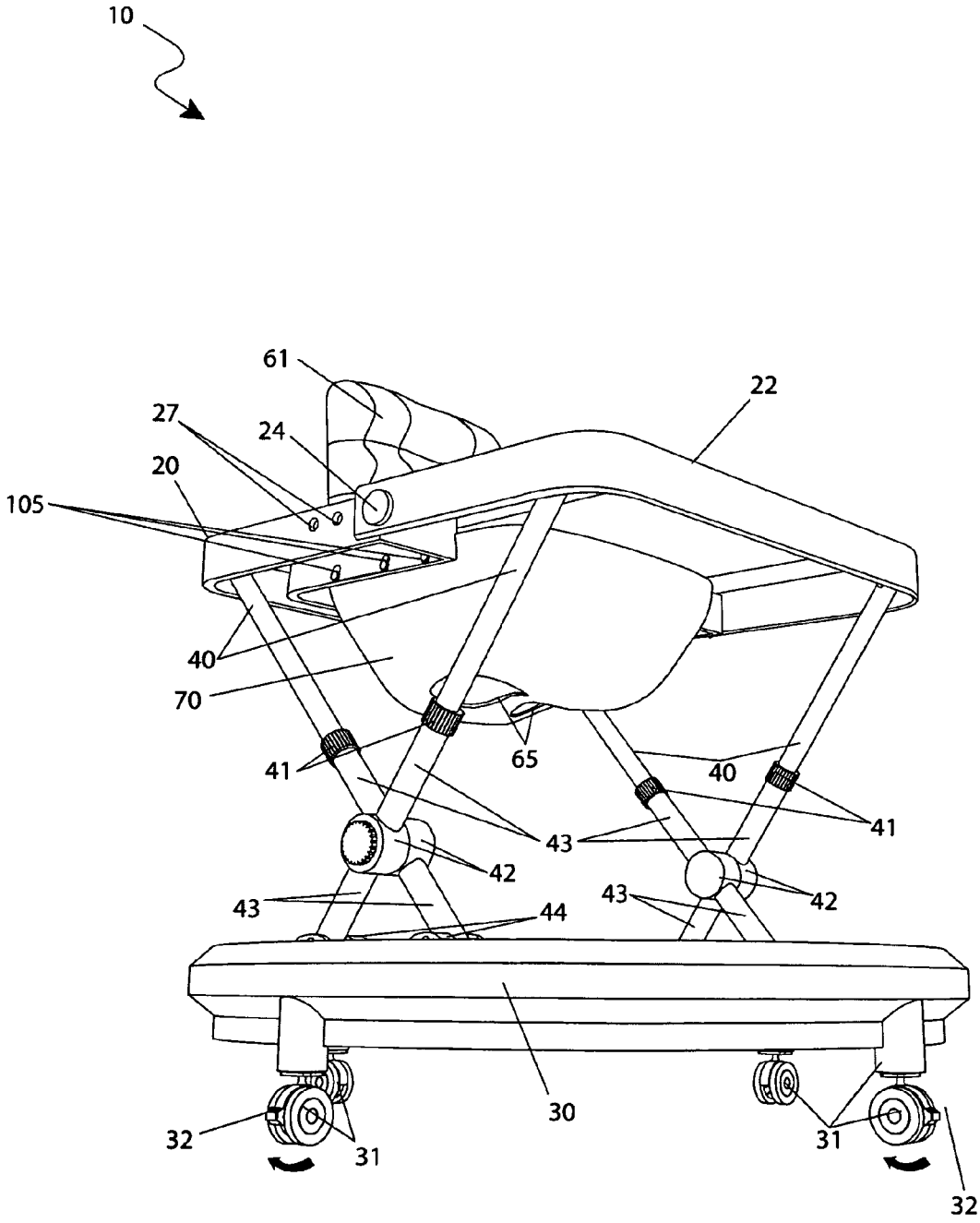
FIG. 3*a* is an upward looking view depicting a walker seat shell 63 configuration of the combination child walker and high chair 10, according to a preferred embodiment of the present invention.
Figure 3B:
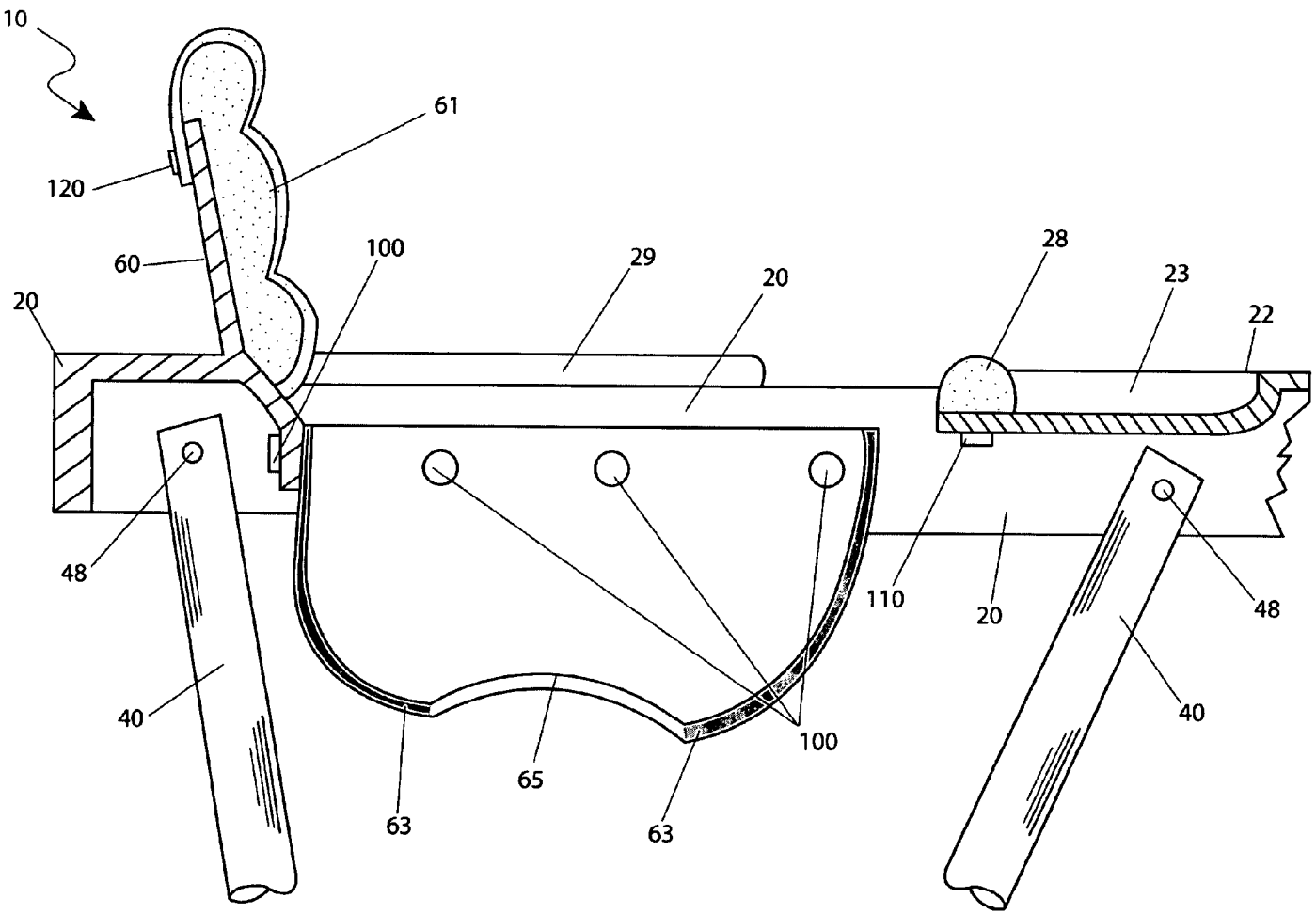
FIG. 3*b* is a section view of a walker seat shell portion 63 taken along section A-A (see FIG. 1) of the combination child walker and high chair 10, according to a preferred embodiment of the present invention.

Referring now to FIGS. 3*a* and 3*b*, upward looking and section views depicting a walker seat shell 63 configuration of the apparatus 10, according to a preferred embodiment of the present invention, are disclosed. The apparatus 10 comprises an easily interchangeable seat portion, thereby allowing utilization of the apparatus 10 as a walker or a high chair. The apparatus 10 comprises a textile walker seat shell 63, a plurality of locking fasteners 100, and a plurality of keyhole aperture features 105. The walker seat shell 63 comprises a compliant hemispherical-shaped seating means formed to comfortably receive and support a lower torso area of an occupying child. The walker seat shell 63 comprises an assembly of textile panels using conventional sewing techniques. The walker seat shell 63 further comprises a pair of walker seat leg apertures 65 positioned along a bottom surface facing in a generally downward direction and being sized to receive said child's leg portions therethrough. The previously described stationary tray portion 20 provides an attachment means thereto the walker seat shell 63 via a plurality of integrally molded keyhole aperture features 105 arranged along inner vertical surfaces. Said walker seat shell 63 comprises a plurality of equally-spaced locking features 100 therearound an upper perimeter edge at corresponding locations to those of said locking features 100. Said locking features 100 are securely affixed thereto the walker seat shell 63 using common fastening means such as rivets, screws, plastic welding, or the like. Said locking features 100 comprise round-headed protrusions sized so as to be slidingly inserted thereinto said keyhole aperture features 105 in a locking manner (see FIG. 6).

The back rest 61 is depicted here being affixed thereto a back rest support member 60 using a plurality of common fasteners 120. Said back rest support member 60 is integrally-molded thereinto the stationary tray 20 and extending therefrom an edge region directly therebehind the occupying child.

Figure 4A:
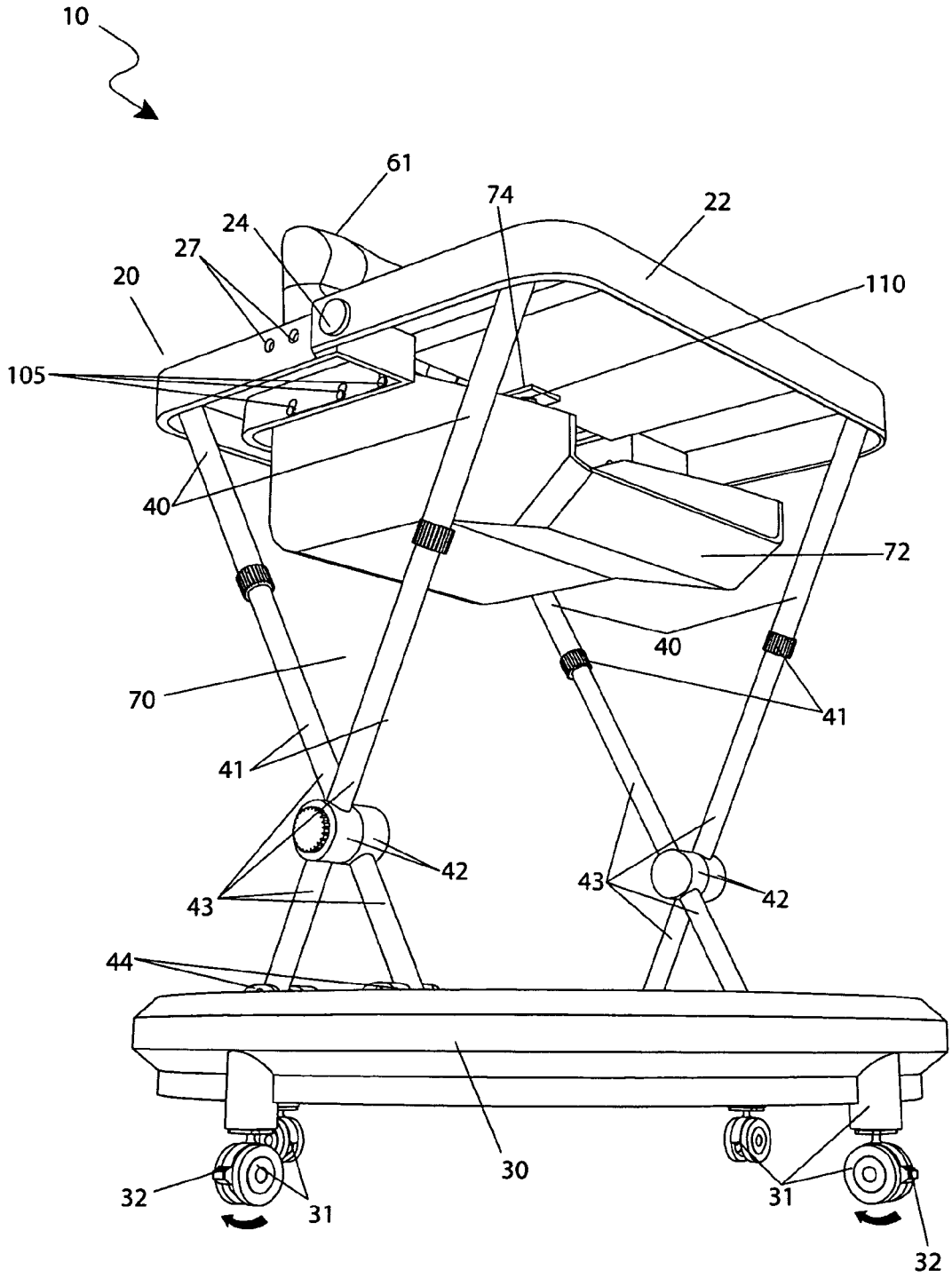
FIG. 4*a* is an upward looking view depicting a high chair seat 70 configuration of the combination child walker and high chair 10, according to a preferred embodiment of the present invention.
Figure 4B:
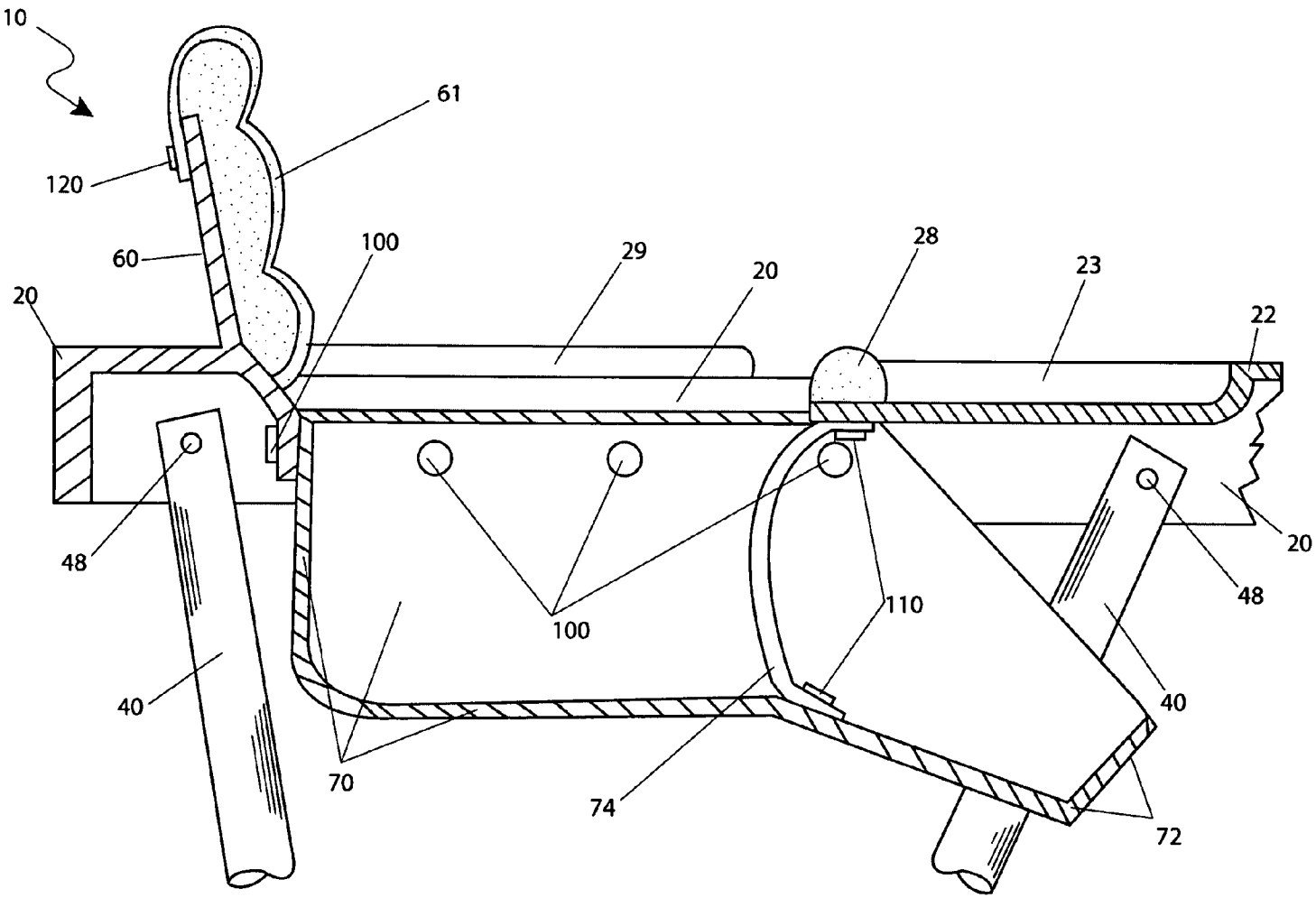
FIG. 4*b* is a section view of a high chair seat portion 70 taken along section A-A (see FIG. 1) of the combination child walker and high chair 10, according to a preferred embodiment of the present invention.

Referring now to FIGS. 4*a* and 4*b*, upward looking and section views depicting a high chair seat 70 configuration of the apparatus 10, according to a preferred embodiment of the present invention, are disclosed. The apparatus 10 comprises an alternate and easily interchangeable seating means in addition thereto the previously described walker seat shell 63, thereby allowing a user to convert the apparatus 10 from a child walker thereinto a high chair. The apparatus 10 as illustrated here comprises a high chair seat 70 and a crotch strap 74. The high chair seat 70 comprises a semi-rigid extruded or injection-molded plastic seat portion designed to receive and support a sitting child. The high chair seat 70 further comprises an integrally-molded "L"-shaped foot rest 72 which extends therefrom a forward edge of said high chair seat 70 thereat a declining angle of approximately twenty (20) degrees from horizontal. Said high chair seat 70 and footrest portions 72 are envisioned being made of durable and easily washable plastics such as, but not limited to: polypropylene, acrylonitrile butadiene styrene (ABS), or the like. The high chair seat 70 and footrest portions 72 are securely supported by the stationary tray 20 via a plurality of affixed locking fasteners 100 in a similar manner as the aforementioned walker seat shell 63, thereby providing safety thereto the child while in a conventional high chair position. The crotch strap 74 comprises a strong nylon or equivalent strapping material which extends vertically therefrom a rearward edge of the adjustable tray 22 downwardly thereto the high chair foot rest portion 72 being removably attached thereto using common heavy-duty two-piece snap fasteners 110.

Figure 5:
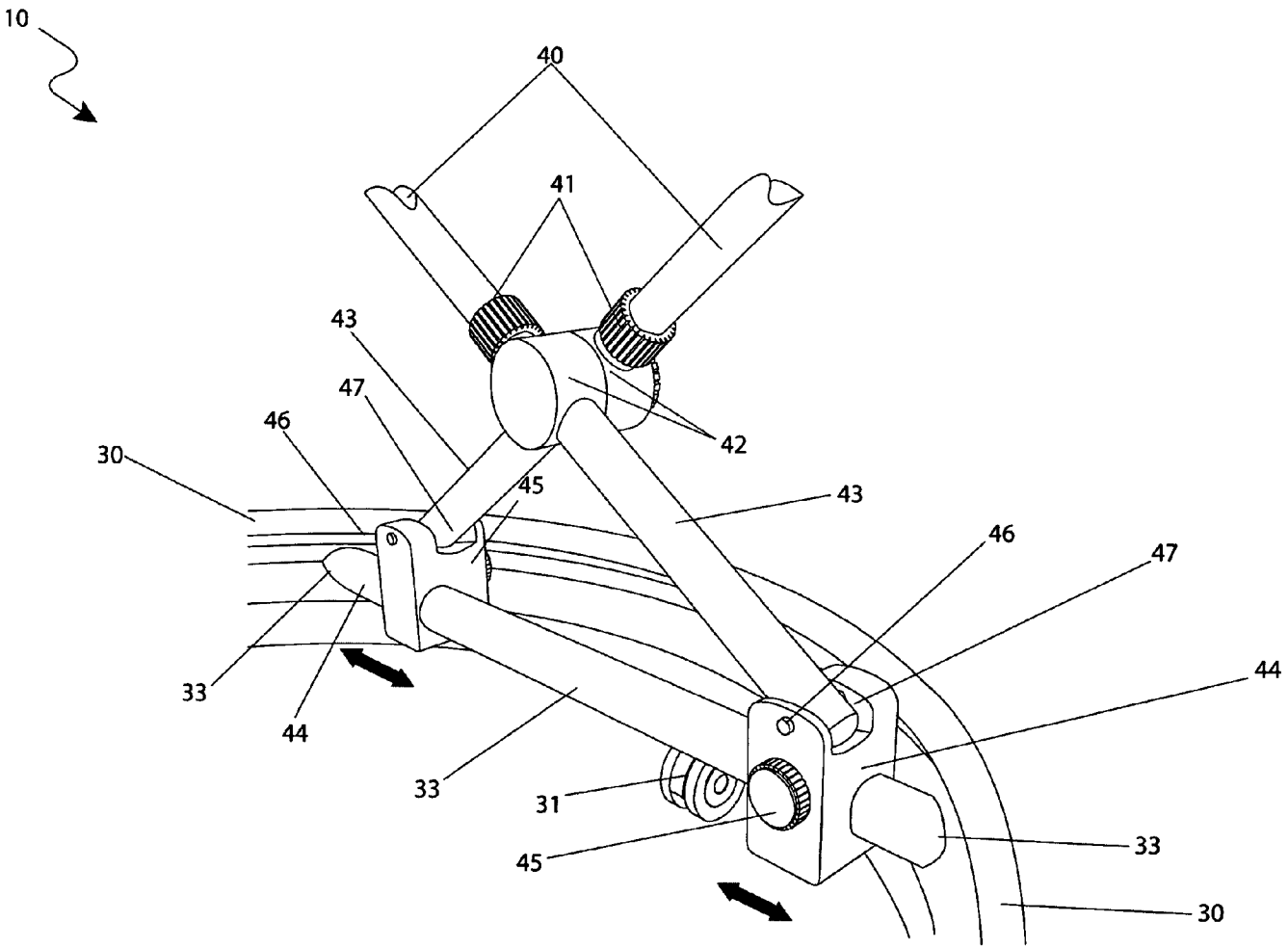
FIG. 5 is a perspective view of a combination child walker and high chair 10 depicting lateral tube clamp portions 44, according to a preferred embodiment of the present invention; and, FIG. 6 is a close-up view of keyhole seat fastener portion 100 of the combination child walker and high chair 10, according to a preferred embodiment of the present invention.

Referring now to FIG. 5, a perspective view of a combination child walker and high chair 10 depicting lateral tube clamp portions 44, according to a preferred embodiment of the present invention, is disclosed. Each lateral tube clamp 44 comprises a lateral tube clamp knob 45, a first pivot pin 46, and a tube pivot slot 47. The lateral tube clamp 44 provides a means for a rotating and sliding attachment of the lower tubes 43 thereto the mounting bars 33. Each mounting bar 33 provides an attachment means thereto a pair of lateral tube clamps 44 via a drilled hole therethrough a lower portion. Said lateral tube clamps 44 are mounted along said mounting bars 33 being rotated one-hundred eighty (180) degrees with respect thereto each other, thereby providing an offset attachment thereto respective lower tubes 43. Said lateral tube clamps 44 are secured thereto a desired relative position along said mounting bar 33 by tightening the lateral tube clamp knob 45. A single-axis pivoting attachment of the lower tube 43 thereto an upper portion of the lateral tube clamp 44 is accomplished via a horizontal first pivot pin 46 being inserted therethrough. The tube pivot slot 47 comprises a cylinder-shaped groove across an upper surface of the lateral tube clamp 44 providing physical clearance thereto the lower tube 43 as it rotates therearound said first pivot pin 46 during adjustment of the apparatus 10.

Figure 6:
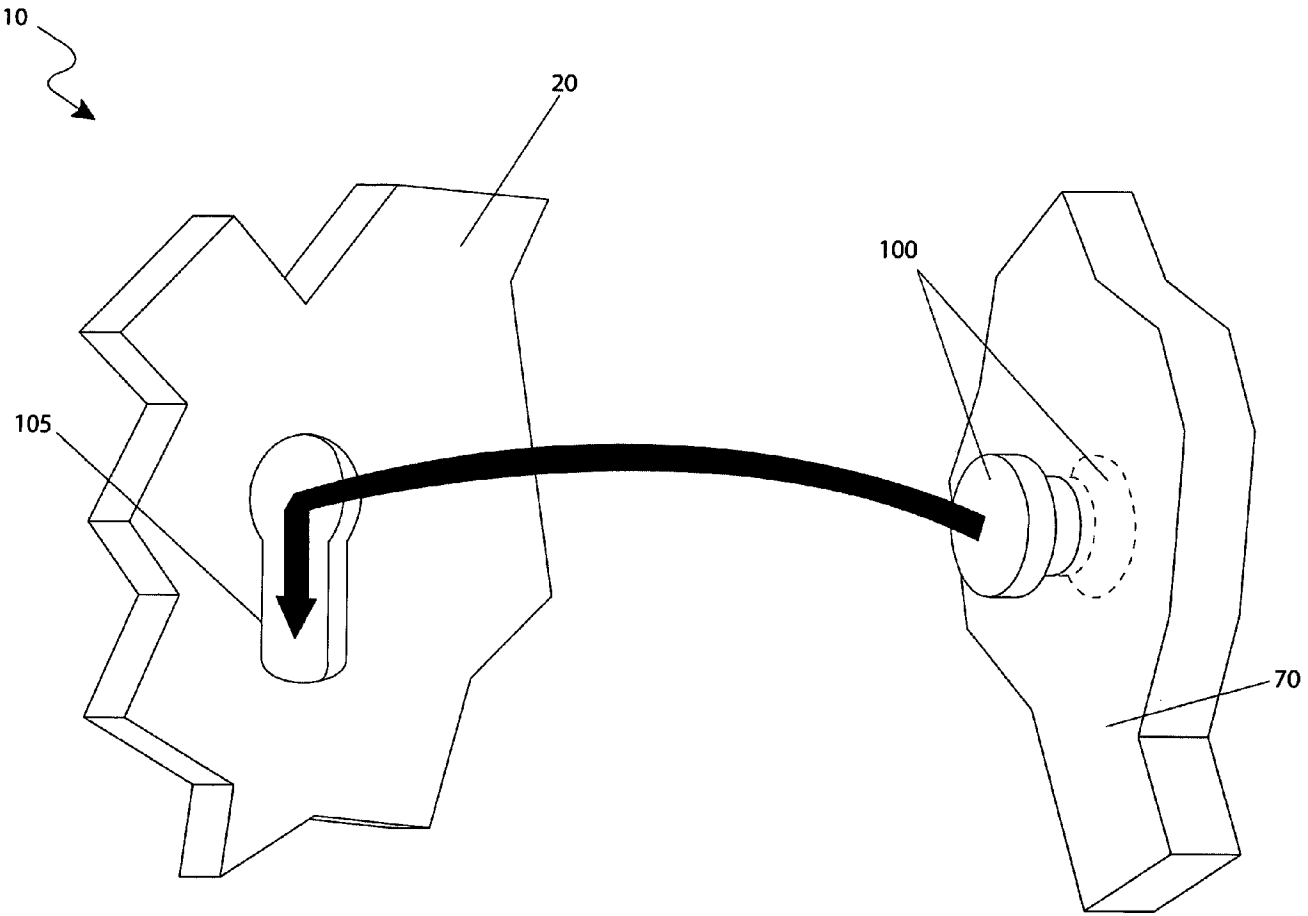

Referring now to FIG. 6, a close-up view of keyhole seat fastener portion 100 of the combination child walker and high chair 10, according to a preferred embodiment of the present invention, is disclosed. Secure attachment of both the walker seat shell 63 and high chair seat 70 thereto the stationary tray portion 20 of the apparatus 10 utilizes a plurality of inserting and locking fasteners 100 shown here affixed thereto the high chair seat portion 70 (see FIGS. 3*a* and 4*a*). Said locking fasteners 100 are in-turn inserted thereinto correspondingly shaped keyhole features 105 using an "in-and-down" motion to provide a mechanical connection to secure said seat 70 thereto. Said locking fasteners 100 are envisioned to be made of strong injection-molded plastic materials such as, but not limited to: polypropylene, acrylonitrile butadiene styrene (ABS), or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of utilizing the apparatus 10 as a walker may be achieved by performing the following steps: installing the textile walker seat shell 63 thereto the stationary tray 20 by inserting and locking the locking fasteners 100 thereinto the keyhole features 105, if not previously installed; adjusting the apparatus 10 to a desired height for operation as a walker by loosening the tube locks 41, the tube joint mechanisms 42, and the lateral tube clamp knobs 45; pressing and collapsing the upper 40 and lower 43 tubes in a downward direction thereto a desired height above a floor surface based upon a length of an occupying child's leg portions; allowing the lateral tube clamps 44 to slide apart from each other along the mounting bars 33; securing a desired walker height by tightening the tube locks 41, the tube joint mechanisms 42, and the lateral tube clamp knobs 45; adjusting a top opening therebetween the stationary 20 and adjustable 22 tray portions, thereby providing a comfortable top opening for an occupying child, by retracting the spring-loaded tray locking mechanisms 24; sliding the adjustable tray portion 22 horizontally in or out based upon said desired opening size; locking the adjustable tray portion 22 in a desired position by releasing and engaging the tray locking mechanism 24 thereinto a pair of aligned adjustment apertures 27; placing the apparatus 10 thereupon a level, or nearly level surface; inserting said child's legs and lower torso thereinto an open area formed between said stationary 20 and adjustable 22 tray portions until securely seated in an expected manner thereupon said walker seat shell 63; unlocking the locking casters 31 using the caster locking mechanisms 32; allowing the child to enjoy recreation and exercise benefits of the apparatus 10 while being configured therein the walker state; and, benefiting therefrom the exercising walker function of the apparatus 10 to train and strengthen a child's legs.

The method of utilizing the apparatus 10 as a high chair may be achieved by performing the following steps: removing the child therefrom the apparatus 10; adjusting the apparatus 10 thereto a desired high chair position by loosening the tube locks 41, the tube joint mechanisms 42, and the lateral tube clamp knobs 45; lifting and extending the upper 40 and lower 43 tubes, thereby allowing the lateral tube clamps 44 to slide toward each other along the mounting bars 33 until a desired high chair height is obtained; tightening the tube locks 41, the tube joint mechanisms 42, and the lateral tube clamp knobs 45 to secure the apparatus 10 thereto said high chair position; removing the walker seat shell 63 and installing the high chair seat 70 and foot rest 72 portions thereto lower surfaces of the stationary tray 20 using the locking fasteners 100 as previously described; adjusting a position of the adjustable tray 22 thereto a desired eating or playing position using the tray locking mechanisms 24 as previously described; securely positioning the apparatus 10 thereat a desired location by locking the casters 31 using the caster locking mechanisms 32; placing the child within the apparatus 10 as described above; and, benefiting therefrom a high chair function of the apparatus 10 to fed or occupy a child's time therewithin the apparatus 10 in an expected manner.

Storage of the apparatus 10 may be accomplished by loosening the tube locks 41, the tube joint mechanisms 42; and the lateral tube clamp knobs 45; pressing and collapsing the upper 40 and lower 43 tubes in a downward direction until reaching a mechanical limitation of the apparatus 10; and, storing said apparatus 10 in a vehicle trunk, closet, or other appropriate area.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An apparatus comprising:

a resilient tubular frame body comprising a telescoping arrangement of tubular elements;

a base attached thereto a lower portion thereof said tubular frame body;

a tray assembly attached thereto an upper portion thereof said tubular frame body;

an interchangeable seat assembly attachable thereto an upper portion thereof said tubular frame body;

wherein said tubular frame body further comprises a pair of mounting bars mounting said lower portion of said tubular frame body to said base, arranged parallel to each other, and positioned and affixed along opposing inside surfaces of said base and affixed thereto;

an adjustable tubular support structure forming a vertically expanding scissor-like structure affixed thereto said pair of mounting bars, further comprising:

a first pair of lower tubes comprising a first lower end mounted to and extending upwardly from a first mounting bar in an offset and converging configuration to form a crossing junction, and a first upper end;

a first pair of lateral tube clamps attaching said first pair of lower tubes to said first mounting bar with a first pair of pivot pins, each slidingly engaged with said first mounting bar;

a second pair of lower tubes comprising a second lower end mounted to and extending upwardly from a second mounting bar in an offset and converging configuration to form a crossing junction, and a second upper end;

a second pair of lateral tube clamps attaching said second pair of lower tubes to said second mounting bar with a second pair of pivot pins, each slidingly engaged with said second mounting bar;

a first tube joint locking mechanism providing a first vertical and angular positioning and securing means to said first pair of lower tubes;

a second tube joint locking mechanism providing a second vertical and angular positioning and securing means to said second pair of lower tubes;

a first pair of upper tubes, comprising a third lower end extending upwardly to a third upper end pivotally attached to said tray assembly;

a first pair of tube locking collars for securing said third lower end of said first pair of upper tubes to said first upper end of said first pair of lower tubes;

a second pair of upper tubes, comprising a fourth lower end extending upwardly to a fourth upper end pivotally attached to said tray assembly; and, a second pair of tube locking collars for securing said fourth lower end of said second pair of upper tubes to said second upper end of said first pair of lower tubes;

wherein said first pair of lateral tube clamps and said second pair of lateral tube clamps each provide an offset and hinging means to said first pair of lower tubes and said second pair of lower tubes, respectively;

wherein said tubular support structure provides a vertically adjusting and securing means for said tray assembly between a lower position and an upper position; and, wherein said apparatus is selectably transformable therefrom a child walker configuration thereto a high chair configuration.

2. The apparatus of claim 1, further comprising:

a pair of first lateral tube clamp knobs; and, a pair of second lateral tube clamp knobs;

wherein said pair of first lateral tube clamp knobs and said pair of second lateral tube clamp knobs provide a securing means thereto said first pair of lower tubes and said second pair of lower tubes at relative convergent angles thereto each other.

3. The apparatus of claim 1, wherein said base further comprises a horizontal ring-shaped foundation with gently curved outwardly facing surfaces;

wherein said base is shaped to provide a protection means thereto environmental objects upon incidental contact therewith said apparatus; and, wherein said base provides an evenly-distributed stabilizing mass thereto said apparatus.

4. The apparatus of claim 3, wherein said base comprises a diameter of approximately three (3) feet.

5. The apparatus of claim 3, further comprising a plurality of casters equidistantly attached thereto a bottom portion thereof said base;

wherein said plurality of casters are spaced to provide a stable and secure resting position therefor said apparatus; and, wherein said plurality of casters provide a transportable means therefor said apparatus therein said child walker configuration.

6. The apparatus of claim 5, further comprising a locking mechanism therefor each of said plurality of casters;

wherein said locking mechanism provides a secure and stable position therefor said apparatus therein said high chair configuration.

7. The apparatus of claim 3, wherein said tray assembly further comprises:

a stationary tray;

a third pair of pivot pins comprising a horizontally extending appendage thereof said stationary tray, providing a first rotary connection means thereto said upper portion thereof said tubular frame body;

a fourth pair of pivot pins comprising a horizontally extending appendage thereof said stationary tray opposite therefrom said third pair of pivot pins, providing a second rotary connection means thereto said upper portion thereof said tubular frame body;

an adjustable tray, comprising a "U"-shaped member providing a slidingly engaging attachment means thereto said stationary tray and a large recessed area centrally located of an upper surface thereof said adjustable tray;

a plurality of tray locking mechanisms adjustably securing said adjustable tray thereto said stationary tray; and, a back rest affixed thereto a back rest support member, comprising a molded portion thereof said stationary tray and rearwardly extending therefrom.

8. The apparatus of claim 7, further comprising cushion members attached thereto said stationary tray.

9. The apparatus of claim 7, further comprising cushion members attached thereto said adjustable tray.

10. The apparatus of claim 7, wherein said plurality of tray locking mechanisms further comprises a plurality of equidistantly spaced adjustment apertures located at opposing outer side surfaces thereof said stationary tray receiving a pair of adjustment pins located at opposing outer surfaces thereof said adjustment tray;

wherein said adjustable tray is horizontally variably positioned or completely removed via said plurality of tray locking mechanisms.

11. The apparatus of claim 7, wherein said interchangeable seat assembly further comprises a seat shell comprising a pair of seat leg apertures positioned along a bottom surface thereof and removably fastened thereto said stationary tray via a plurality of locking fastener assemblies.

12. The apparatus of claim 11, wherein said seat shell further comprises a compliant hemispherical-shaped seating means formed to comfortably receive and support a lower torso area of an occupant.

13. The apparatus of claim 11, wherein said plurality of locking fastener assemblies further comprise a plurality of molded aperture features equidistantly spaced along inner vertical surfaces thereof said stationary tray for receiving a plurality of equidistantly spaced locking features therearound an upper perimeter edge thereof said seat shell.

14. The apparatus of claim 7, wherein said interchangeable seat assembly further comprises a high chair seat with an integrally molded foot rest extending forwardly therefrom at a declining angle and a removably crotch strap extending vertically therefrom a rearward edge thereof said adjustable tray downwardly thereto said foot rest;

wherein said high chair seat is removably attached thereto said stationary tray via a plurality of locking fastener assemblies.

15. The apparatus of claim 14, wherein said plurality of locking fastener assemblies further comprise a plurality of molded aperture features equidistantly spaced along inner vertical surfaces thereof said stationary tray for receiving a plurality of equidistantly spaced locking features therearound an upper perimeter edge thereof said high chair seat.

16. A method of utilizing a combined apparatus adjustable and transformable therebetween a child walker configuration and a high chair configuration comprises the following steps:

providing said combined apparatus, further comprising:

a resilient tubular frame body comprising an upper portion and a lower portion, further comprising:

a pair of mounting bars mounting said lower portion thereof said tubular frame body thereto a base, arranged parallel thereto each other, and positioned and affixed along opposing inside surfaces thereof said base and affixed thereto;

a first pair of lower tubes comprising a first lower end mounted thereto and extending upwardly therefrom a first mounting bar in an offset and converging configuration to form a crossing junction, and a first upper end;

a first pair of lateral tube clamps attaching said first pair of lower tubes thereto said first mounting bar therewith a first pair of pivot pins, each slidingly engaged therewith said first mounting bar;

a second pair of lower tubes comprising a second lower end mounted thereto and extending upwardly therefrom a second mounting bar in an offset and converging configuration to form a crossing junction, and a second upper end;

a second pair of lateral tube clamps attaching said second pair of lower tubes thereto said second mounting bar therewith a second pair of pivot pins, each slidingly engaged therewith said second mounting bar;

a first tube joint locking mechanism providing a first vertical and angular positioning and securing means thereto said first pair of lower tubes;

a second tube joint locking mechanism providing a second vertical and angular positioning and securing means thereto said second pair of lower tubes;

a first pair of upper tubes, comprising a third lower end extending upwardly thereto a third upper end pivotally attached thereto said tray assembly;

a first pair of tube locking collars for securing said third lower end thereof said first pair of upper tubes thereto said first upper end thereof said first pair of lower tubes;

a second pair of upper tubes, comprising a fourth lower end extending upwardly thereto a fourth upper end pivotally attached thereto said tray assembly; and, a second pair of tube locking collars for securing said fourth lower end thereof said second pair of upper tubes thereto said second upper end thereof said first pair of lower tubes;

a pair of first lateral tube clamp knobs; and, a pair of second lateral tube clamp knobs;

said base comprising a horizontal ring-shaped foundation with gently curved outwardly facing surfaces;

a plurality of casters each comprising a locking mechanism and equidistantly attached thereto a bottom portion thereof said base a tray assembly attached thereto an upper portion thereof said tubular frame body, further comprising:

a stationary tray with attachable cushion members;

a third pair of pivot pins comprising a horizontally extending appendage thereof said stationary tray, providing a first rotary connection means thereto said upper portion thereof said tubular frame body;

a fourth pair of pivot pins comprising a horizontally extending appendage thereof said stationary tray opposite therefrom said third pair of pivot pins, providing a second rotary connection means thereto said upper portion thereof said tubular frame body;

an adjustable tray with attachable cushion members, comprising a "U"-shaped member providing a slidingly engaging attachment means thereto said stationary tray and a large recessed area centrally located of an upper surface thereof said adjustable tray;

a plurality of tray locking mechanisms adjustably securing said adjustable tray thereto said stationary tray; and, a back rest affixed thereto a back rest support member, comprising a molded portion thereof said stationary tray and rearwardly extending therefrom;

utilizing said combined apparatus therein said child walker configuration; and, utilizing said combined apparatus therein said high chair configuration.

17. The method of claim 16, wherein said step of utilizing said combined apparatus therein said child walker configuration further comprises the following steps:

installing a seat shell thereto said stationary tray by inserting and locking a plurality of equidistantly spaced locking features therearound an upper perimeter edge thereof said seat shell thereinto a desired plurality of molded aperture features equidistantly spaced along inner vertical surfaces thereof said stationary tray;

adjusting said combined apparatus to a desired child walker height by loosening said first pair of tube locking collars and said second pair of tube locking collars, said first tube joint locking mechanism, said second tube joint locking mechanism, said pair of first lateral tube clamp knobs, and said pair of second lateral tube clamp knobs;

pressing and collapsing said first pair of upper tubes, said second pair of upper tubes, said first pair of lower tubes, and said second pair of lower tubes in a downward direction, thereby allowing said first pair of lateral tube clamps to slide toward each other along said first mounting bar and said second pair of lateral tube clamps to slide toward each other along said second mounting bar until said desired child walker height is reached;

tightening said first pair of tube locking collars, said second pair of tube locking collars, said first tube joint locking mechanism, said second tube joint mechanism, said pair of first lateral tube clamp knobs, and said pair of second lateral tube clamp knobs to secure said combined apparatus thereto said high chair position;

adjusting a top opening therebetween said stationary tray and said adjustable tray portions to a desired opening size, thereby providing a comfortable top opening for an occupant, by retracting a pair of adjustment pins located at opposing outer surfaces thereof said adjustment tray therefrom one (1) pair of a plurality of equidistantly spaced adjustment apertures located at opposing outer side surfaces thereof said stationary tray;

sliding the adjustable tray horizontally in or out based upon said desired opening size;

securing said adjustable tray at said desired opening size by releasing and engaging said pair of adjustment pins thereinto one (1) pair of a plurality of equidistantly spaced adjustment apertures;

inserting an occupant's legs and lower torso thereinto an open area formed between said stationary tray and said adjustable tray until securely seated thereupon said seat shell;

unlocking said plurality of locking casters; and, allowing said occupant to utilize said combined apparatus therein said child walker configuration.

18. The method of claim 16, wherein said step of utilizing said combined apparatus therein said high chair configuration further comprises the following steps:

removing said occupant therefrom said combined apparatus;

adjusting said combined apparatus thereto a desired high chair position by loosening said first pair of tube locking collars and said second pair of tube locking collars, said first tube joint locking mechanism, said second tube joint locking mechanism, said pair of first lateral tube clamp knobs, and said pair of second lateral tube clamp knobs;

lifting and extending said first pair of upper tubes, said second pair of upper tubes, said first pair of lower tubes, and said second pair of lower tubes, thereby allowing said first pair of lateral tube clamps to slide toward each other along said first mounting bar and said second pair of lateral tube clamps to slide toward each other along said second mounting bar until said desired high chair position is obtained;

tightening said first pair of tube locking collars, said second pair of tube locking collars, said first tube joint locking mechanism, said second tube joint mechanism, said pair of first lateral tube clamp knobs, and said pair of second lateral tube clamp knobs to secure said combined apparatus thereto said high chair position;

installing a high chair seat comprising a foot rest thereto lower surfaces thereof said stationary tray by inserting and locking a plurality of equidistantly spaced locking features therearound an upper perimeter edge thereof said high chair seat thereinto a desired plurality of molded aperture features equidistantly spaced along inner vertical surfaces thereof said stationary tray;

adjusting a top opening therebetween said stationary tray and said adjustable tray portions to a desired opening size, thereby providing a comfortable top opening for an occupant, by retracting a pair of adjustment pins located at opposing outer surfaces thereof said adjustment tray therefrom one (1) pair of a plurality of equidistantly spaced adjustment apertures located at opposing outer side surfaces thereof said stationary tray;

sliding the adjustable tray horizontally in or out based upon said desired opening size;

securing said adjustable tray at said desired opening size by releasing and engaging said pair of adjustment pins thereinto one (1) pair of a plurality of equidistantly spaced adjustment apertures;

securely positioning said combined apparatus thereat a desired location by locking said plurality of locking casters;

placing an occupant child within said combined apparatus until securely seated thereupon said high chair seat; and, allowing said occupant to utilize said combined apparatus therein said high chair configuration.

* * * * *